US008016162B2

(12) United States Patent
Cleary et al.

(10) Patent No.: US 8,016,162 B2
(45) Date of Patent: Sep. 13, 2011

(54) CONDIMENT BOTTLE

(75) Inventors: Wayne C. Cleary, Glenshaw, PA (US); Michael D. McMahon, Bethel Park, PA (US)

(73) Assignee: H.J. Heinz Company, Pittsburgh, PA (US)

( * ) Notice: Subject to any disclaimer, the term of this patent is extended or adjusted under 35 U.S.C. 154(b) by 1068 days.

(21) Appl. No.: 11/477,903

(22) Filed: Jun. 30, 2006

(65) Prior Publication Data

US 2008/0000932 A1 Jan. 3, 2008

(51) Int. Cl.
*B65D 37/00* (2006.01)

(52) U.S. Cl. ..... 222/215; 222/212; 222/556; 215/216; 215/235; 215/316; 215/384; 220/675; 220/837

(58) Field of Classification Search ..... 222/212–215, 222/490–491, 494, 556, 562–563, 546, 544; 215/206, 216, 231, 235, 316, 379–385; 220/666, 220/669, 836–837, 675
See application file for complete search history.

(56) References Cited

U.S. PATENT DOCUMENTS

| | | | | | |
|---|---|---|---|---|---|
| D38,385 | S | * | 12/1906 | Kohn | D9/542 |
| D082,202 | S | | 9/1930 | Winegard | |
| D92,436 | S | * | 6/1934 | Stevens | D9/543 |
| D116,862 | S | | 9/1939 | Mas | |
| D124,122 | S | | 12/1940 | Teunisz | |
| D131,470 | S | | 3/1942 | Key | |
| 2,991,896 | A | | 7/1961 | Glover et al. | |
| D195,000 | S | | 4/1963 | Goldsholl | |
| D201,585 | S | | 7/1965 | Roberts | |
| D217,585 | S | | 5/1970 | Lambelet | |
| D217,805 | S | | 6/1970 | Douglas | |
| D223,436 | S | | 4/1972 | Hills | |
| D234,911 | S | * | 4/1975 | Stevens | D9/529 |
| D236,432 | S | | 8/1975 | O'Brien | |
| D238,554 | S | | 1/1976 | Pardo | |
| D242,691 | S | | 12/1976 | Koenigsberg | |
| D249,228 | S | | 9/1978 | Schacher et al. | |
| D250,170 | S | | 11/1978 | Strand | |
| D252,014 | S | | 6/1979 | Furlong et al. | |
| D262,778 | S | | 1/1982 | Britt et al. | |
| 4,349,134 | A | * | 9/1982 | Schuster et al. | 222/212 |
| 4,394,134 | A | * | 7/1983 | Rowe | 44/390 |
| D273,092 | S | | 3/1984 | Kretz | |
| 4,666,068 | A | * | 5/1987 | Bush | 222/546 |
| D294,121 | S | | 2/1988 | Cramer | |
| D308,483 | S | | 6/1990 | Weckman | |
| D312,131 | S | | 11/1990 | Esteves | |

(Continued)

FOREIGN PATENT DOCUMENTS

EP 276198 A2 * 7/1988

*Primary Examiner* — Kevin P Shaver
*Assistant Examiner* — Andrew Bainbridge
(74) *Attorney, Agent, or Firm* — Buchanan, Ingersoll & Rooney P.C.

(57) ABSTRACT

A bottle formed of a food-grade plastic material, such as clear polyethylene terephthalate includes a frustoconical neck portion, a shoulder region, a base region, and a sidewall portion have opposed grip-enhancing surfaces, and elastically deformable pressure panels. A cap for the container may include a valve to control product leakage, and may be sized to allow inversion of the bottle. A generally trapezoidal tab of the cap moves between a closed position covering a cap orifice and an open position outside the plane of the cap.

9 Claims, 8 Drawing Sheets

U.S. PATENT DOCUMENTS

D312,878 S 12/1990 Mariol
D317,987 S 7/1991 Demarest
5,105,989 A * 4/1992 Gutkowski ..... 222/182
D333,268 S 2/1993 Arlinghaus et al.
D337,525 S 7/1993 Collette et al.
5,226,638 A 7/1993 Ausilio
5,261,544 A * 11/1993 Weaver, Jr. ..... 215/384
D343,791 S 2/1994 Pitaknarongphorn
5,301,845 A 4/1994 Labonte
D352,246 S 11/1994 Samimi et al.
D364,092 S 11/1995 Feen
D366,618 S 1/1996 Brillet et al.
5,482,172 A * 1/1996 Braddock ..... 222/478
D371,849 S 7/1996 Thom
D376,980 S 12/1996 LoPreto
D379,307 S 5/1997 Marriage
D383,847 S 9/1997 Skinner
D384,889 S 10/1997 Nasrallah
D386,085 S 11/1997 Green
D391,853 S 3/1998 Green et al.
D405,000 S 2/1999 Mikol et al.
D408,290 S 4/1999 Verdura et al.
5,897,033 A * 4/1999 Okawa et al. ..... 222/212
D412,281 S 7/1999 Lindsay et al.
D413,267 S 8/1999 Mohary
D413,807 S 9/1999 Mikla
D414,117 S 9/1999 Mikla
D416,791 S 11/1999 Albrecht et al.
D421,910 S 3/2000 Warner et al.
D426,953 S 6/2000 Vanden Dries et al.
D428,339 S 7/2000 Johnston et al.
D428,342 S 7/2000 Stoller
D428,813 S 8/2000 Haley
D440,318 S 4/2001 Meyers et al.
D447,955 S * 9/2001 Beaver et al. ..... D9/542
D450,596 S 11/2001 Adee et al.
D451,032 S 11/2001 Iizuka et al.
6,311,878 B1 * 11/2001 Kimble et al. ..... 222/556
D456,271 S 4/2002 Maloney
D462,272 S 9/2002 Baijnath et al.
D471,821 S 3/2003 McMahon et al.
6,575,321 B2 6/2003 Bourque et al.
D476,577 S 7/2003 McMahon et al.
D477,229 S 7/2003 McMahon et al.
D481,639 S 11/2003 Crawford
D486,071 S 2/2004 Deubel et al.
6,749,075 B2 * 6/2004 Bourque et al. ..... 215/384
D496,281 S 9/2004 Trude
D505,077 S 5/2005 Piccioli et al.
6,913,405 B2 * 7/2005 Fischer et al. ..... 401/6
D511,970 S 11/2005 Cleary
D512,322 S 12/2005 Collins et al.
D525,527 S 7/2006 Ogg
D525,528 S 7/2006 Lane et al.
D539,659 S * 4/2007 Cleary et al. ..... D9/542
D567,096 S * 4/2008 Toh ..... D9/542

* cited by examiner

CONDIMENT BOTTLE

BACKGROUND

This disclosure generally concerns a plastic condiment bottle. More particularly, this disclosure generally relates to a stable, invertable bottle adapted for refrigerator storage.

SUMMARY

A bottle according to the preferred embodiment includes a container and a closure which may be in the form of a cap. The cap may be generally cylindrical, generally frustoconical, or generally polygonal. In some embodiments, the cap may include a generally trapezoidal tab moveable between open and closed positions. At the closed position, the tab preferably covers a dispensing orifice of the cap. At the open position, the tab may be engaged by a detent arrangement that holds the tab below the plane of the cap.

An embodiment of the container portion of the bottle may include a neck having a cap end to which the cap may be threadably connected. The neck may join a shoulder region which, in turn, may join a sidewall region. That sidewall region may join a base region adapted to support the bottle in an upright position. In a preferred embodiment, the shoulder region and the base region may be similarly shaped, and may be generally octogonal.

Preferably, the sidewall region has cross-sectional dimensions that are smaller than corresponding cross-sectional dimensions of the base and shoulder regions. The sidewall region may include a pair of side surfaces adapted to enhance the gripability of the container. The sidewall region preferably includes a pair of pressure panels on opposed major surfaces of the container. These pressure panels have a peripheral region and a central region, where the central region is constructed to be more easily elastically deformed when subjected to squeezing pressure that is the peripheral region.

Proportions of the bottle may preferably be selected so that the bottle is accommodated by typical door shelving of a refrigerator. To that end, the cross-section of the container may be generally rectangular or generally octagonal, or generally polygonal. For example, the transverse cross-section of the shoulder region and base region of the bottle may be generally polygonal. The sides of the bottle need not meet at sharp corners and may include curved sides.

An invertable bottle according to the preferred embodiment is adapted for storage in both an upright position and an inverted position. Inverted storage positions are both useful and important for viscous materials which may not readily move from one end of the bottle to the other for dispensing purposes. To restrict product leakage from the bottle, the cap may also include a valve element covering the inner portion of the cap orifice.

BRIEF DESCRIPTION OF THE DRAWINGS

Many objects and advantages of the bottle according to this description will be apparent to those skilled in the art when this written specification is read in conjunction with the appended drawings wherein like reference numerals are applied to like elements, and wherein.

DETAILED DESCRIPTION OF THE PREFERRED EMBODIMENT

Figure 1:
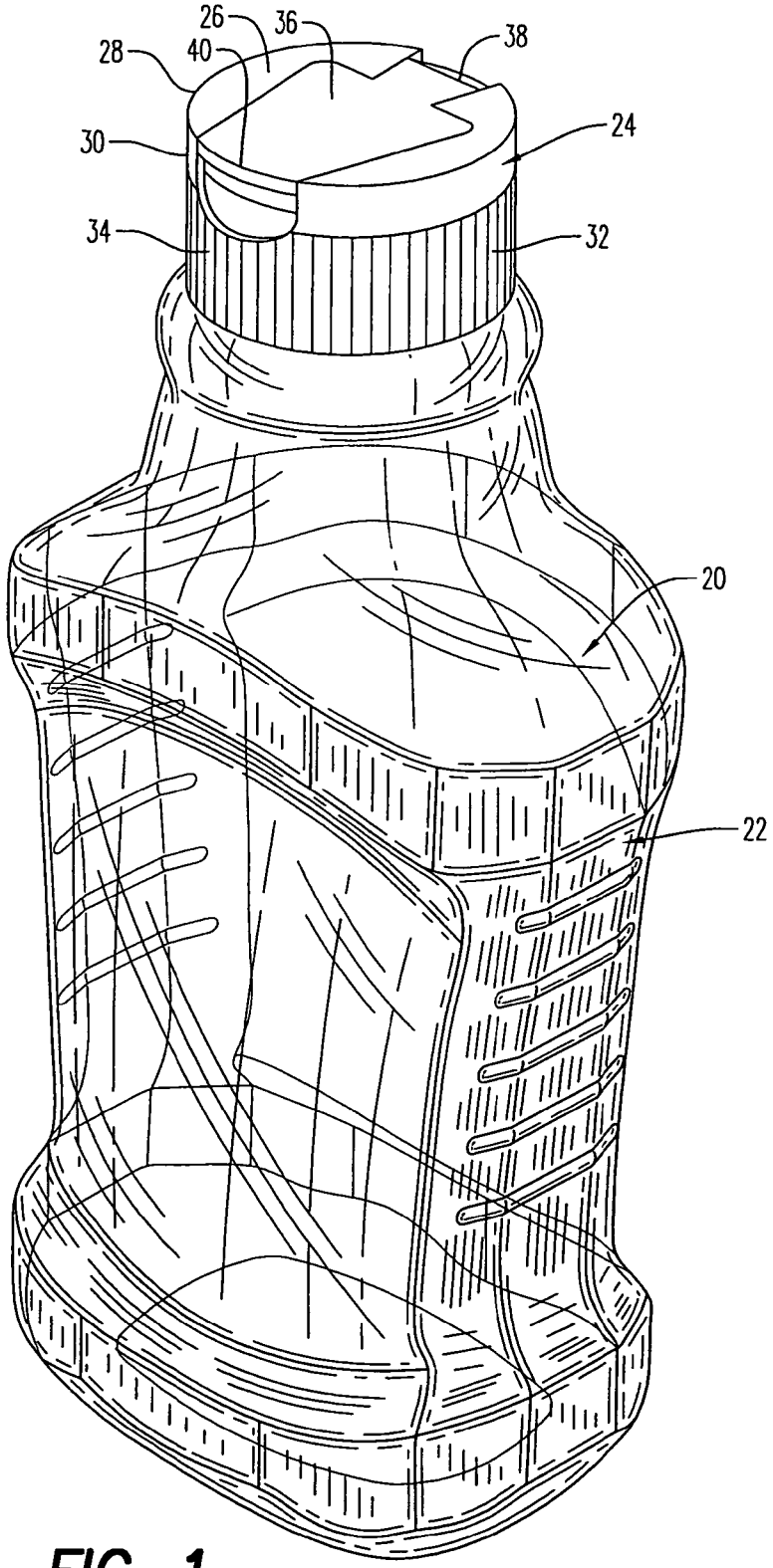
FIG. 1 is a perspective view of an invertable bottle according to the present invention.

Turning now to FIG. 1, a preferred embodiment of a bottle 20 is shown. The bottle 20 is suitable for use in packaging and marketing products such as condiments. Typical condiments are mustard, relish, mayonnaise, salsa, tomato ketchup, and the like. Where a particular condiment is widely used, a large container may be desired. For purposes of this description, a large container means a container having a volumetric capacity ranging from 40 to 64 fluid ounces or more.

The bottle 20 preferably includes a container 22 to which a cap 24 may be attached. The cap 24 may be attached to the container 22 in any desired manner. Preferably, the cap 24 may be attached with a threaded connection so that the cap 24 can be removed for access to the contents of the container 22. Alternatively, however, the cap 24 may be connected to the container 22 using a snap-on connection, or any other suitable connecting arrangement.

Preferably, the container 22 and the cap 24 are fabricated from suitable conventional food-grade plastic materials. For example, the container 22 may be fabricated from polyethylene terephthalate. For applications where it is desirable to see the contents of the container 22, the container may be fashioned from a clear, or substantially transparent material. For purposes of this description, a substantially transparent material includes those materials which are transparent, as well as materials that are sufficiently translucent that the level of contents in the container 22 can be evaluated without removing the cap 24 from the container 22.

The cap 24 includes a flat, generally planar top surface 26. By providing a flat top surface 26, the surface can function to support the bottle in an inverted position should a consumer elect to do so. In addition, the cap 24 includes a body portion 30 which extends downwardly from a periperal edge 28 of the top surface 26. Where the top surface 26 is generally circular, a side surface 32 of the body portion 20 may be generally cylindrical, or generally frustoconical. For purposes of this description generally cylindrical should be interpreted to include a purely cylindrical surface as well as a surface including one or more cylindrical portions. Similarly, for purposes of this description, generally frustoconical should be interpreted to include a surface that is purely frustoconical as well as a surface having one or more frutoconical portions. If desired, the cap 24 may include knurling, parallel ridges 34, or the like that may enhance a consumer's grip on the cap 24 during attachment to or removal from the container 22.

For an application where the bottle 20 will be used to both dispense and store a condiment, the cap 24 may include a cap orifice through which such dispensing may occur. To cover that cap orifice during storage, the cap 24 may include an openable tab 36 positioned in the flat top surface 26. The tab 36 may be connected with the body portion 30 of the cap 24 by an integral hinge 38. Moreover, the tab 36 may extend to the peripheral edge 28 of the top surface 26 so that an edge 40 of the tab 36 is accessible to a consumer to facilitate opening the tab 36.

Figure 3:
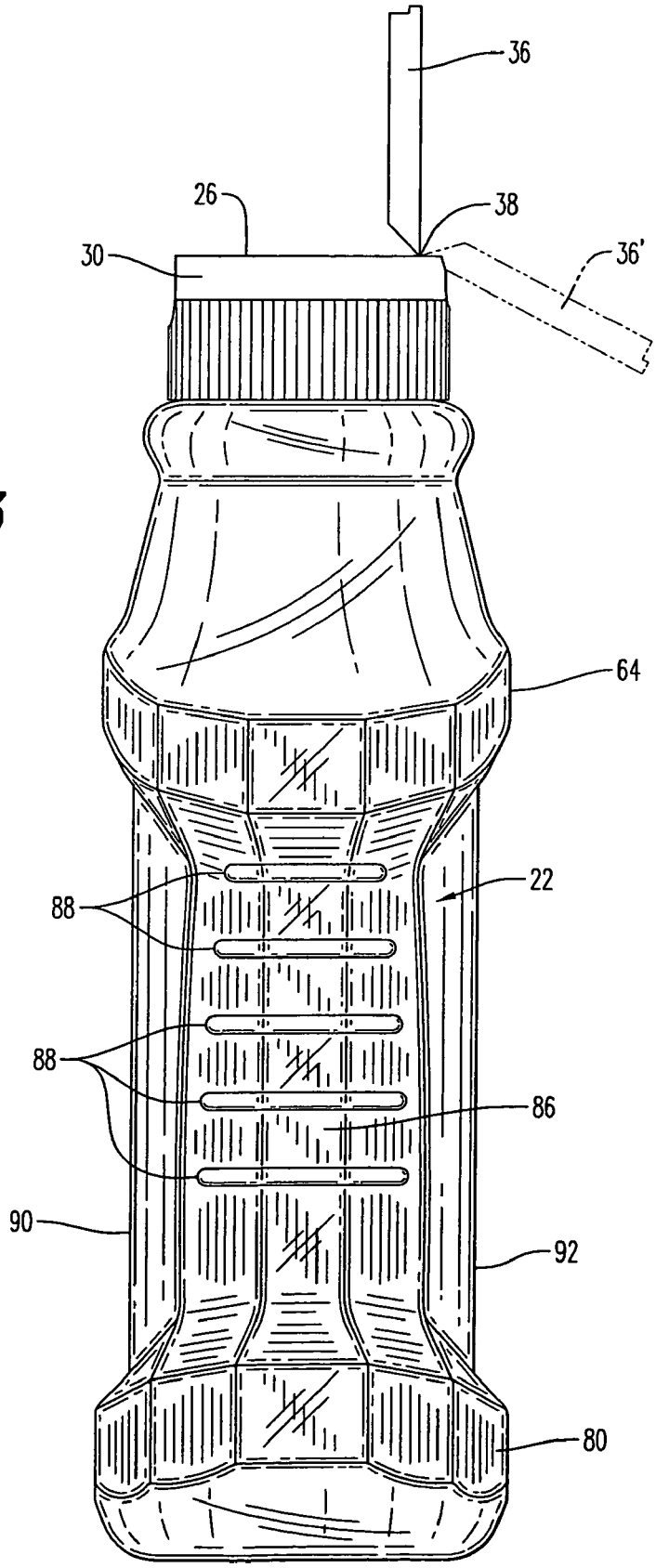
FIG. 3 is a side elevational view of the invertable bottle of FIG. 2 with the cap opened.

The tab 36 is movable between a first closed position illustrated in FIG. 1 and a second, fully opened position 36' shown in FIG. 3. In the fully opened position 36', the tab 36 may be engaged by a conventional frictional detent of the cap body 30 to hold the tab 36 out of the path of any condiment that may be dispensed. To this end, the hinge 38 of the tab 36 is positioned at or below the plane of the top surface 26 of the cap 24. Moreover, the fully opened position 36' is arranged so that the tab 36 is substantially below the plane of the top surface 26. The word "below" has a positional and orientational connotation that is not intended for purposes of this description. Rather, the word "below" is intended as a shorthand reference to the concept that the tab is positioned relative to the top surface 26 on the same side of that surface 26 as the container 22. The phrase "substantially below" is intended to encompass an arrangement where a minor portion of the tap may protrude above the plane of the top surface 26.

Figure 2:
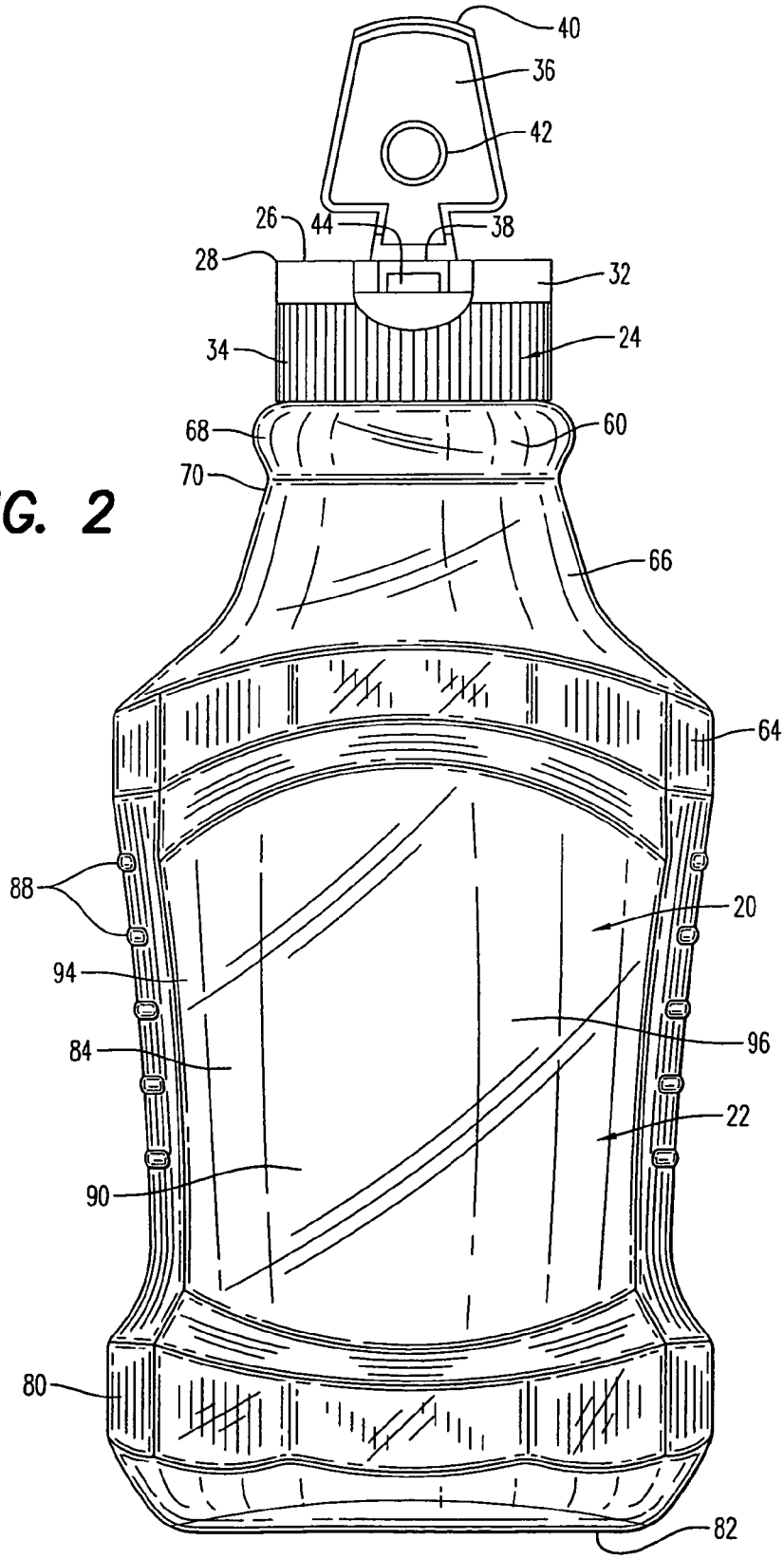
FIG. 2 is a front elevational view of the invertable bottle of FIG. 1 with the cap opened.

While various shapes of the tab 36 are within the contemplation of this disclosure, a preferred shape is the generally trapezoidal arrangement depicted in FIGS. 1, 3, 4, and 5. As best seen in FIG. 2, the edge surface 40 of the tab 36 may be slightly curved. As also seen in FIG. 2, the corners of the tab 36 need not be sharp. Rather, the corners may be rounded or filleted. The phrase "generally trapezoidal" as used in this description is intended to encompass trapezoidal shapes of the type described and illustrated. From FIG. 2 it can also be seen that the underside of the tab 36 includes a generally cylindrical collar 42. That collar 42 is sized to receive a projection 44 of the cap body 30 which surrounds the cap orifice. Accordingly, when the tab 36 is in the closed position, cooperation between the projection 44 of the cap body and the collar 42 of the tab 36 is effective to substantially seal the container contents.

Although the tab 36 has been illustrated and described as being generally trapezoidal, other shapes for the tab are also within the contemplation of this disclosure. For example, the tab 36 might be substantially quadrilateral, substantially elliptical, oval, substantially polygonal, and like. For purposes of this description, the word "substantially" is intended to encompass not only the precise geometric shape but also shapes having similar defining characteristics but being variations that may include rounded corners, rounded sides, and other deviations from precise geometric characterization.

Figure 5:
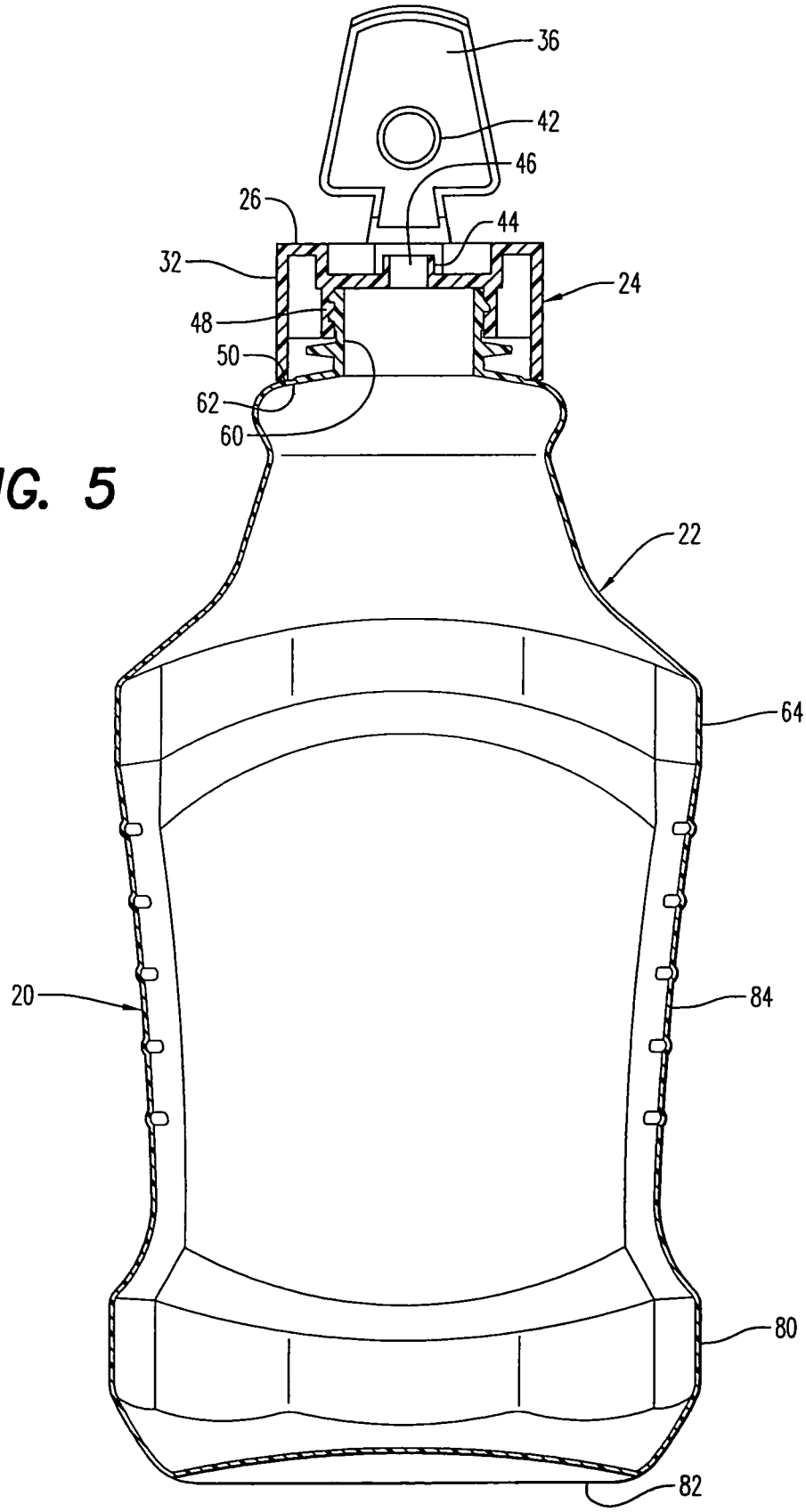
FIG. 5 is a cross-sectional view taken along the line 5-5 of FIG. 4, but where the cap is open.

Turning to FIG. 5, the cap 24 preferably includes an internally threaded collar 48 which is substantially concealed by the body 32 of the cap 24. The threaded collar 48 has threads which conform to external threads provided on the cap end 60 of the container 22. Surrounding the cap end 60 of the container 22 is a radially outwardly extending, frustoconical surface 62. When the cap 24 is securely attached to the container 22, the bottom edge 50 of the cap 24 is spaced from the frustoconical surface by a small gap, preferably in the range of about 15 to about 50 thousandths of an inch. That small gap between the container and the bottom edge of the cap insures that the top of the container finish (i.e., the top surface) contacts the inner sealing surface of the cap 24. That contact is assured even where the container initially includes a seal that is removed to permit access to the container contents. With that arrangement, should the bottle be inverted and rest on the flat surface of its cap 24, the bottle is stable against tipping.

In applications where the bottle is intended for inverted storage, the orifice 46 (see FIG. 6) is preferably provided with a valve 49 to regulate dispensing of product from the container 22. The valve 48 may be integrally attached to an inner portion of the cap body 32. A suitable valve 48 may comprise a membrane extending across the cap orifice 46, where the membrane has an arcuate portion directed toward the container 22. The arcuate portion of the membrane may be provided with a intersecting slits to define a plurality of generally triangular leaves. When contents of the container are pressurized for dispensing, the triangular leaves bend toward the open end of the cap orifice 46 allowing product to pass through the cap orifice. When the dispensing pressure is released, the triangular leaves spring back to their original position and operate to block passage of product through the cap orifice 46. The leaves of the valve are sufficiently resilient that they do not bend open unless the applied pressure exceeds the hydraulic static head pressure generated by a full container of condiment.

The container 22 (see FIG. 2) includes the cap end 60 which extends to a shoulder region 62. Extending between the cap end 60 and the shoulder region 64 is a neck portion 66 that may be include a frustoconical surface portion. The neck portion 66 also includes a radially enlarged rib 68 adjacent to the cap 24. The rib 68 may comprise part of a toroidal surface, or another surface of revolution. Regardless of its precise shape, the rib 68 includes the frustoconical surface 62 shown in FIG. 5. The rib 68 functions to define a groove 70 so that the container 22 can be securely held near the cap 24 without slipping.

Figure 4:
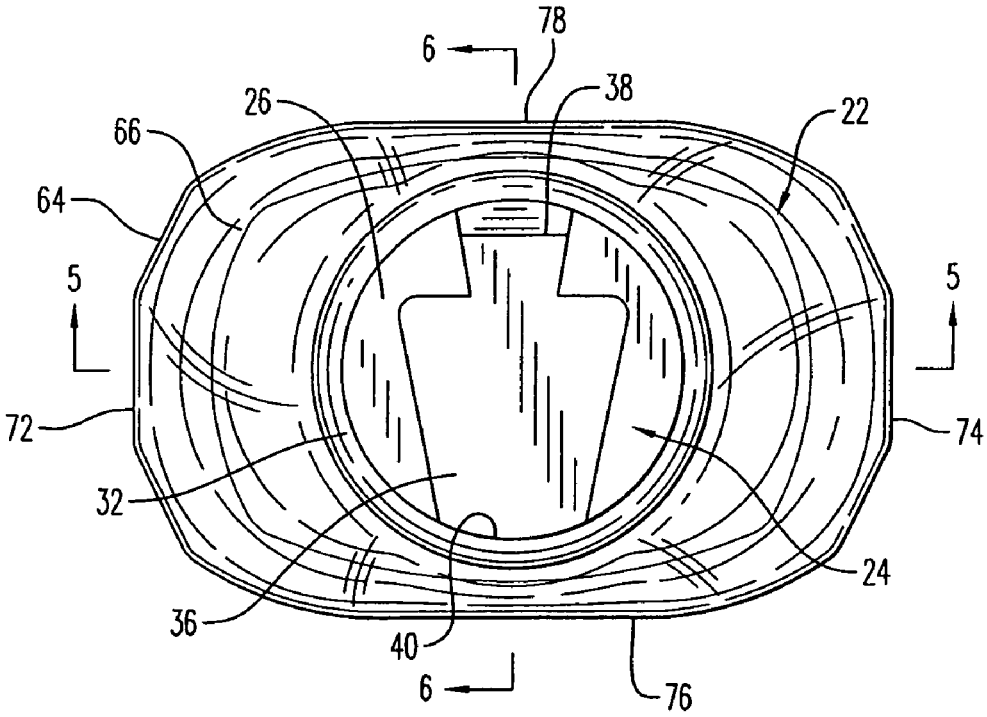
FIG. 4 is a top view of the invertable bottle of FIG. 1 with the cap closed.
Figure 7:
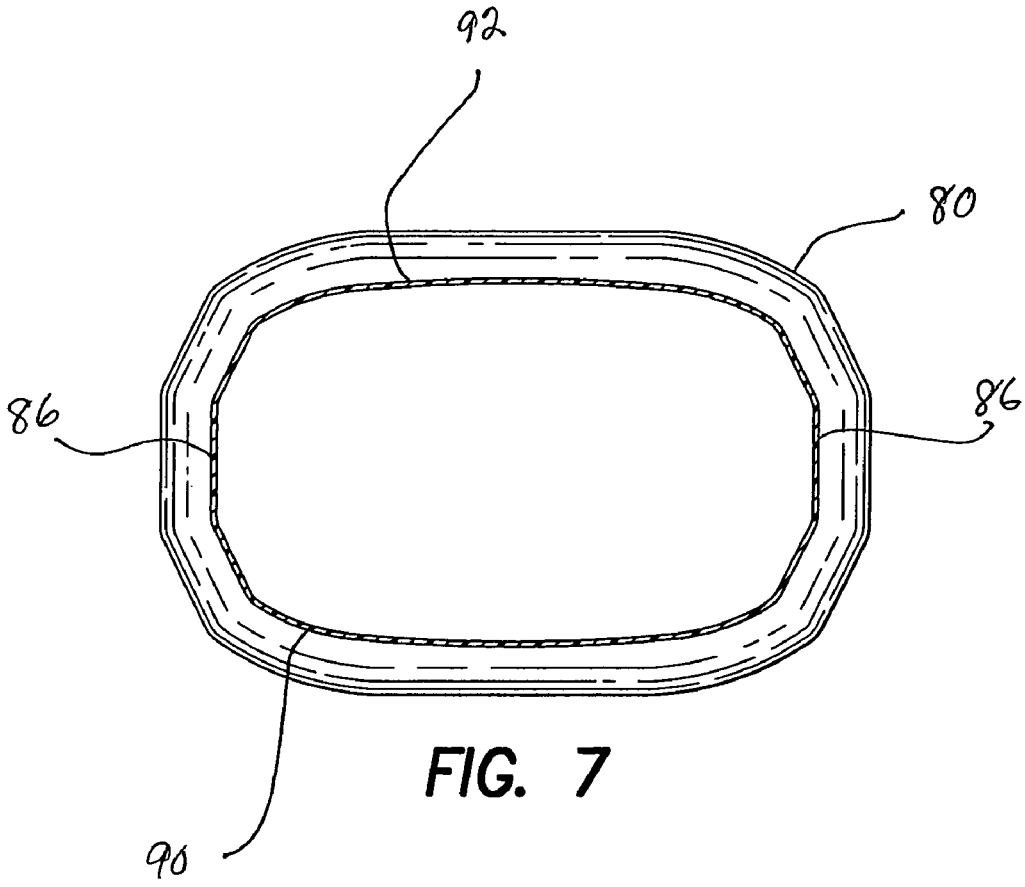
FIG. 7 is a cross-section view taken along the line 7-7 of FIG. 6.

As best seen in FIG. 4, the shoulder region 64 has a cross-sectional contour or shape that is generally octagonal. Each of two opposed ends 72, 74 of the shoulder region are formed by three corresponding substantially straight sides. Two opposed major sides 76, 78 of the should region 64 extend between the opposed ends 72, 74 and are generally curved. Alternatively, the shoulder region 64 has a generally polygonal transverse cross-section, the sides of which need not meet at sharp corners and may include curved sides as shown in FIG. 7.

Figure 8:
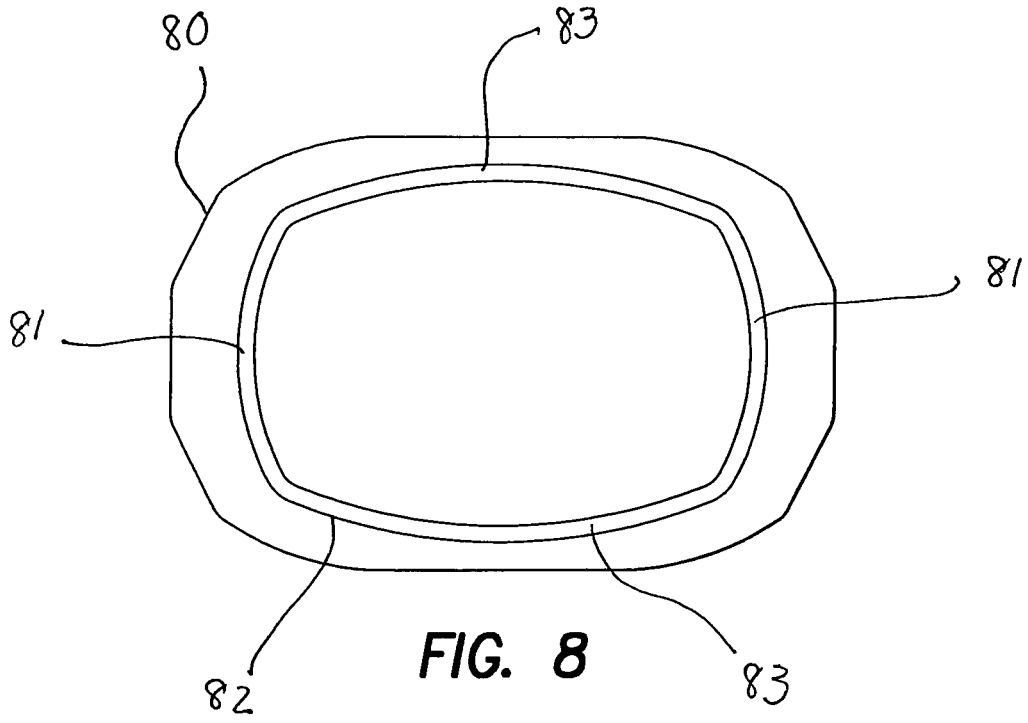
FIG. 8 is a bottom view of the container.

The container 22 also includes a bottom region 80 (see FIG. 2) spaced from the shoulder region 64 but having a cross-sectional contour substantially similar to the cross-sectional contour of the shoulder region 64. The bottom region 80 also defines the bearing surface 82 on which the container 22 rests when standing in its upright position. The bearing surface 82 may be generally rectangular, but is positioned within the cross-sectional contour of the bottom region 80 (see FIG. 8). More particularly, the bearing surface 82 may be fashioned as four generally arcuate sides 81, 83. The arcuate sides 83 extend to the maximum thickness or depth of the container consistent with allowing a molding fillet at the bottom edge of the bqase portion of the container. The second pair of arcuate sides 81 extend in the width direction of the container, and can allow a generous molding fillet at the bottom edge of the base portion of the container. With this shape and location, the container provides exceptional stability against tipping.

Figure 6:
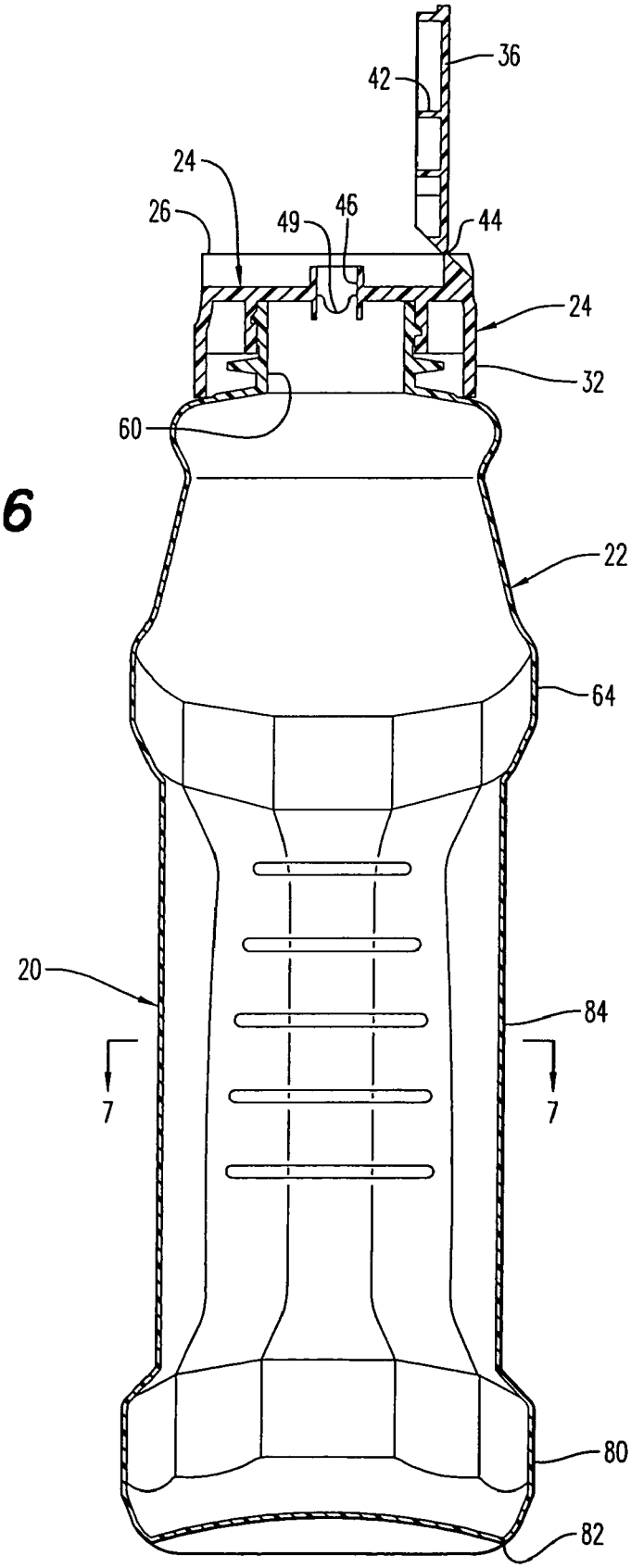
FIG. 6 is a cross-sectional view taken along the line 6-6 of FIG. 4, but where the cap is open.

A side wall region 84 extends between the shoulder region 64 and the base region 80 of the container 22. As best seen in FIGS. 5 and 6, the sidewall region 84 has dimensions that are smaller than corresponding dimensions of the cross-sectional contour of the shoulder region 64 and the cross sectional contour of the base region 80. This arrangement permits the thickness of the container 22 to be sized to comfortably fit in a normal-size hand between the thumb and opposed fingers. Moreover, this arrangement defines protrusions that permit the container to be held upright without slipping downwardly through the hand and to be held inverted without slipping downwardly through the hand.

To further enhance the secureness of a hand grip, the sidewall portion 84 includes a pair of gripping surfaces 86, one on each side of the container 22. Each gripping surface 84 may include, for example, a plurality of transverse ribs 88 to comfortably engage a hand between the thumb and fingers to resist slippage. While ribs have been illustrated, other grip-enhancing structures could be substituted, as desired.

The sidewall region 84 further includes a pair of opposed squeezable panels 90, 92 (see FIG. 3). The squeezable panels 90, 92 comprise major surfaces of the container 22, and a located between the shoulder region 64 and the base region 80. Each squeezable panel 90, 92 has a peripheral region 94 and a central region 96. The peripheral region 94 is contiguous with the two gripping surfaces 84, the shoulder region 64, and the base region 80. The central region 96 is surrounded by the peripheral region 94. The central region 96 is elastically deformable in response to pressure applied by a thumb or by one or more fingers. Moreover, the central region 96 elastically deforms with less pressure than is required to elastically deform the peripheral region 94 by the same amount. Further, the wall thickness of the squeezable panel 90 is selected such that both the central region 96 and the peripheral region 94 remain free of creases during elastic deformation in response to applied pressure.

Operation of the squeezable panel 90, 92 may be better understood by an examination of FIGS. 2, 6 and 7. In cross section (FIG. 6), the portion of the shoulder region 64 adjacent to the squeezable panels 90, 92 resembles a U-shaped top channel member. The top channel member (see FIG. 2) is also curved downwardly open at its center. That complex three-dimensional configuration provides a top channel member which is quite stiff against bending and flexing. Similarly, in cross section the portion of the base region 80 (FIG. 6) adjacent to the squeezable panels 90, 92 also resembles a U-shaped channel member. As such, this bottom channel member is also quite stiff against bending and flexing. As best seen in FIG. 7, the grippable panels 86 along each side of the container generally resemble U-shaped side channel members fashioned from substantially straight side portions, where these side channel members are adjacent to the squeezable panels 90, 92. Here again, these side channel members are quirte stiff against bending and flexing. With the central region 96 of each squeezable panel being spaced from the frame created by the four channel members, the least resistance to squeezing is located at the center of each of the squeezable panels 90, 92.

The bottle of this disclosure exhibits improved stability against tipping when compared to earlier large volume condiment containers, that improved stability occurs both for upright and inverted positions of the bottle. Tipping stability is accomplished by a variety of features of the bottle. As seen in FIG. 5, the distance between the planar surface 26 of the cap 24 and the shoulder region 64 is less that the distance between the shoulder region and the bearing surface 82. With that arrangement, the center of gravity for a full container lies in the bottom half of the container 22 in the upright position. And, the center of gravity for a full container lies closer to the planar surface 26 of the cap than for a conventional bottle. Since a lower center of gravity enhances stability, the short neck region described above promotes stability. As the contents of the bottle are removed or used, the product level in the bottle 20 is lowered in both the upright and the inverted positions. Accordingly, the center of gravity for the bottle 20 becomes even closer to the bearing surface 82 in the upright position and to the planar surface 26 of the cap 24 in the inverted position. Thus, as the bottle empties, stability in both the upright and inverted positions is enhanced relative to the full bottle.

In the inverted position, there are additional features of the bottle 20 that provided enhanced tipping stability. More specifically, the cap 24 of the bottle 20 is sized to promote tipping stability. The cap 24 will have a nominal transverse dimension regardless of its peripheral shape. For example, a generally square cap would have a nominal dimension corresponding to the distance between its sides. A generally pentagonal cap would have a nominal dimension corresponding to the distance from one corner to the opposite side. In the case of a generally cylindrical cap 24, the nominal transverse dimension would be a diameter of the cap 24.

As seen in FIG. 5, the container 22 has a nominal transverse dimension which may be selected as the maximum width of the shoulder region 64. If viewed from FIG. 6, the container 22 also has a nominal transverse dimension which may be selected as the maximum thickness or depth of the shoulder region 64. For stability purposes, a ratio of the cap nominal dimension to the predetermined container nominal transverse dimension preferably lines in the range of about 0.4 to about 1.0. Where the predetermined container transverse dimension is selected as the width of the shoulder region 64, a more preferred ratio of the cap nominal dimension to the predetermined width is about 0.6. Where the predetermined container transverse dimension is selected as the thickness of the shoulder region, a more preferred ratio of the cap nominal dimension to the predetermined thickness is about 0.44.

Another way at characterizing the proportions of the bottle is to recognize that the container 22 has a height measured between the bearing surface 82 and the top of the cap end 62. Non cylindrical containers will also have a major transverse width and a minor transverse width, both being measured substantially perpendicular to the height. Tipping stability is enhanced where the ratio of such major width to the height lies in the range of about 0.4 to about 0.6 and the ratio of such minor width to the height lies in the range of about 0.3 to about 0.36.

Another significant attribute of the bottle 20 having the features described above concerns its storability in conventional household refrigerators. Consumer often face an insufficiency of storage space in their refrigerators. Large volume containers that need refrigeration after being opened often exacerbate such storage space insufficiencies. In recent years, refrigerator manufacturers have addressed that storage issue by providing shelving on the inside of the refrigerator door. Such refrigerator door shelving typically has a nominal depth and usually includes a fence or barrier having a nominal height. Usually the shelf nominal depth is on the order of 4 to 5 inches, while the shelf fence height is also on the order of 4 to 5 inches. Moreover, shelves are spaced vertically from one another by a distance sufficient to accommodate half-gallon or two-liter soda or juice containers.

The bottle 20 described above is also designed for storage on such shelves of a typical refrigerator door. To this end, the height of the bottle 20 preferably does not exceed about 10 inches. Moreover, the nominal transverse depth of the container 22 is preferably selected to be less than the typical shelf depth. In addition, the distance from the planar surface 26 of the cap 24 to the shoulder region 64 is preferably selected to be less that the typical shelf fence height. With these constraints on the bottle proportions and the tipping stability considerations, the bottle 20 is adapted for refrigerator door storage that is stable against tipping in both the upright and inverted positions of the bottle.

Where the term "about" has been used in this description and is associated with a numerical value, it is intended to encompass a tolerance of 5% above and below the associated numerical value.

It will now be apparent that a unique bottle has been described in the foregoing detailed description, which description is intended to be illustrative and not limiting. Moreover, it will be apparent to those skilled in the art that numerous modifications, variations, and equivalents exist for features of the bottle that have been described. Accordingly, it is expressly intended that all such modifications, variations, and equivalents that fall within the spirit and scope of the invention as defined by the appended claims be embraced by those appended claims.

What is claimed is:

1. A condiment bottle comprising:

a shaped, one-piece container fashioned from synthetic plastic material having a neck with a cap end and a second end, a central axis extending from the cap end through the second end, the cap end having a cross section, the second end having a cross section, said cap end cross section forming a first plane, said second end cross section forming a second plane, said cap end cross section being substantially parallel to said second end cross section, said central axis intersecting the central portions of said cap end cross section and said second end cross section, two perpendicular directions defined relative to the central axis that are perpendicular to one another and simultaneously to the central axis defining a width direction and a depth direction respectively, a shoulder region integral with the second end of the neck and having a generally C-shaped portion curved so as to be downwardly open, having a generally U-shaped cross-section located in a plane intersecting the central axis, having a generally polygonal transverse shape and including a first pair of symmetrical surfaces in the plane having portions generally parallel with respect to the central axis, a nominal transverse dimension of the shoulder region cross section measured in the width direction, a base region spaced vertically from the shoulder region and having a base C-shaped portion curved so as to be upwardly open, having a generally U-shaped cross-section located in a plane intersecting the central axis, having a generally polygonal transverse cross-section, and including a second pair of symmetrical surfaces in the plane having portions generally parallel with respect to the central axis, and a sidewall region extending along the central axis between the shoulder region and the base region and defining a pair of squeezable panels, said shoulder region transverse shape being substantially similar to said base region transverse cross-section, the sidewall having a cross-section in a plane substantially perpendicular to the central axis that has a smaller width and depth than the shoulder region transverse shape;

a cap attached to the cap end of the neck, having a generally planar surface, and having a cap nominal dimension in the width direction of said generally planar top surface in the first plane; and wherein the ratio of the cap nominal dimension to the nominal transverse dimension lies in the range of about 0.4 to about 1.0;

wherein said first pair of symmetrical surfaces of said shoulder region have an upper and a lower edge, said upper edge forming the uppermost edge of said symmetrical surfaces, said lower edge forming the lowest edge of said symmetrical surfaces, said upper edge having a continuous curve along the length of said upper edge, and said lower edge having a continuous curve along the length of said lower edge, said upper edge and said lower edge having substantially the same curve.

2. The condiment bottle of claim 1 wherein the shoulder portion is generally octagonal in cross section.

3. The condiment bottle of claim 1 wherein the base portion is generally octagonal in cross section.

4. A container comprising:

a shaped, one-piece vessel fashioned from synthetic plastic material, having a neck with an open end having an exposed edge and a second end, a central axis extending from the open end through the second end, the open end having a cross section, the second end having a cross section, said cap end cross section forming a first plane, said second end cross section forming a second plane, said open end cross section being substantially parallel to said second end cross section, said central axis intersecting the central portions of said open end cross section and said second end cross section, two perpendicular directions defined relative to the central axis that are perpendicular to one another and simultaneously to the central axis defining a width direction and a depth direction respectively, a shoulder region integral with the second end of the neck and having a generally C-shaped portion curved so as to be downwardly open, having a generally U-shaped cross-section located in a plane intersecting the central axis, having a generally polygonal transverse shape, and including a first pair of symmetrical surfaces in the plane having portions generally parallel to the central axis, a nominal transverse dimension of the shoulder region cross section measured in the width direction, a base region spaced from the shoulder region along the central axis and having a base C-shaped portion curved so as to be upwardly open, having a generally U-shaped cross-section located in a plane intersecting the central axis, a generally polygonal transverse shape, and including a second pair of symmetrical surfaces generally parallel to the central axis, and a bearing portion, and a sidewall region extending along the central axis between the shoulder region and the base region and defining a pair of squeezable panels, the shoulder region transverse shape being substantially similar to the base region transverse shape, the sidewall having a cross-section in a plane substantially perpendicular to the central axis that has a smaller width and depth than the shoulder region transverse shape;

wherein the distance from the exposed edge of the open end to the shoulder region is less than the distance between the shoulder region and the base region;

wherein the shoulder portion defines a major width;

wherein the container has a height measured between the exposed edge and the bearing portion;

wherein the ratio of the major width to the height lies in the range of about 0.4 to about 0.6; and wherein said first pair of symmetrical surfaces of said shoulder region have an upper and a lower edge, said upper edge forming the uppermost edge of said symmetrical surfaces, said lower edge forming the lowest edge of said symmetrical surfaces, said upper edge having a continuous curve along the length of said upper edge, and said lower edge having a continuous curve along the length of said lower edge, said upper edge and said lower edge having substantially the same curve.

5. The condiment bottle of claim 4 wherein the shoulder portion is generally octagonal in cross section.

6. A container comprising:

a shaped, one-piece vessel fashioned from synthetic plastic material, having a neck with an open end having an exposed edge and a second end, a central axis extending from the open end through the second end, the open end having a cross section, the second end having a cross section, said cap end cross section forming a first plane, said second end cross section forming a second plane, said open end cross section being substantially parallel to said second end cross section, said central axis intersecting the central portions of said open end cross section and said second end cross section, two perpendicular directions defined relative to the central axis that are perpendicular to one another and simultaneously to the central axis defining a width direction and a depth direction respectively, a shoulder region integral with the second end of the neck and having a generally C-shaped portion curved so as to be downwardly open, having a generally U-shaped cross-section located in a plane intersecting the central axis, having a generally polygonal transverse shape, a first pair of symmetrical surfaces in the plane having portions generally parallel to the central axis, a nominal transverse dimension of the shoulder region cross section measured in the width direction, a base region spaced from the shoulder region along the central axis and having a base C-shaped portion curved so as to be upwardly open, having a generally U-shaped cross-section located in a plane intersecting the central axis, a generally polygonal transverse shape, a second pair of symmetrical surfaces generally parallel to the central axis, and a bearing portion, and a sidewall region extending along the central axis between the shoulder region and the base region and defining a pair of squeezable panels, the shoulder region transverse shape being substantially similar to the base region transverse shape, the sidewall having a cross-section in a plane substantially perpendicular to the central axis that has a smaller width and depth than the shoulder region transverse shape;

wherein the distance from the exposed edge of the open end to the shoulder region is less than the distance between the shoulder region and the base region;

wherein the shoulder portion defines a major width;

wherein the container has a height measured between the exposed edge and the bearing portion;

wherein the ratio of the major width to the height lies in the range of about 0.4 to about 0.6; and wherein said first pair of symmetrical surfaces of said shoulder region have an upper and a lower edge, said upper edge forming the uppermost edge of said symmetrical surfaces, said lower edge forming the lowest edge of said symmetrical surfaces, said upper edge having a continuous curve along the length of said upper edge, and said lower edge having a continuous curve along the length of said lower edge, said upper edge and said lower edge having substantially the same curve.

7. The condiment bottle of claim 6 wherein the base portion is generally octagonal in cross section.

8. A condiment bottle comprising:

a shaped, one-piece container fashioned from synthetic plastic material having a neck having a cap end with an exposed edge and a second end, a central axis extending from the cap end through the second end, the cap end having a cross section, the second end having a cross section, said cap end cross section forming a first plane, said second end cross section forming a second plane, said cap end cross section being substantially parallel to said second end cross section, said central axis intersecting the central portions of said cap end cross section and said second end cross section, two perpendicular directions defined relative to the central axis that are perpendicular to one another and simultaneously to the central axis defining a width direction and a depth direction respectively, a shoulder region integral with the second end of the neck and having a generally C-shaped portion curved so as to be downwardly open, having a generally U-shaped cross-section located in a plane intersecting the central axis, having a generally polygonal transverse shape and including a first pair of symmetrical surfaces in the plane having portions generally parallel with respect to the central axis, a nominal transverse dimension of the shoulder region cross section measured in the width direction, a base region spaced vertically from the shoulder region and having a base C-shaped portion curved so as to be upwardly open, having a generally U-shaped cross-section located in a plane intersecting the central axis, having a generally polygonal transverse cross-section, and including a second pair of symmetrical surfaces in the plane having portions generally parallel with respect to the central axis, and a sidewall region extending along the central axis between the shoulder region and the base region and defining a pair of squeezable panels, said shoulder region transverse shape being substantially similar to said base region transverse cross-section, the sidewall having a cross-section in a plane substantially perpendicular to the central axis that has a smaller width and depth than the shoulder region transverse shape;

a cap attached to the cap end of the neck, having a generally planar surface, and having a cap nominal dimension in the width direction of said generally planar top surface in the first plane; and wherein the container has a height measured between the exposed edge and the bearing portion;

wherein the ratio of the cap nominal dimension to the nominal transverse dimension lies in the range of about 0.4 to about 1.0;

wherein the ratio of the nominal transverse dimension to the height lies in the range of about 0.4 to about 0.6; and wherein said first pair of symmetrical surfaces of said shoulder region have an upper and a lower edge, said upper edge forming the uppermost edge of said symmetrical surfaces, said lower edge forming the lowest edge of said symmetrical surfaces, said upper edge having a continuous curve along the length of said upper edge, and said lower edge having a continuous curve along the length of said lower edge, said upper edge and said lower edge having the substantially the same curve.

9. The condiment bottle of claim 8 wherein the shoulder portion is generally octagonal in cross section and wherein the base portion is generally octagonal in cross section.

* * * * *